US005698799A

United States Patent [19]

Lee, Jr. et al.

[11] Patent Number: 5,698,799

[45] Date of Patent: Dec. 16, 1997

[54] ZONE ISOLATOR MODULE FOR USE ON A PENETROMETER

[76] Inventors: Landris T. Lee, Jr., 204 Azalea La.; Daniel A. Leavell, 418 Ridgewood Dr.; Philip G. Malone, 107 Fox Run La., all of Vicksburg, Miss. 39180

[21] Appl. No.: 659,856

[22] Filed: Jun. 7, 1996

[51] Int. Cl.[6] ..... E21B 49/10

[52] U.S. Cl. ..... 73/866.5; 73/864.74; 175/21; 175/59; 175/230

[58] Field of Search ..... 73/152.17, 152.26, 73/152.28, 864.73, 864.74, 864, 863.21, 866.5, 84; 175/20, 21, 58, 59, 60, 230, 243

[56] References Cited

U.S. PATENT DOCUMENTS

| | | | |
|---|---|---|---|
| 2,210,546 | 8/1940 | Hassler | 166/1 |
| 2,564,198 | 8/1951 | Elkins | 73/155 |
| 2,751,016 | 6/1956 | Watzlavick | 166/187 |
| 3,008,521 | 11/1961 | Boucher | 166/4 |
| 3,223,184 | 12/1965 | Jones et al. | 175/243 X |
| 3,235,017 | 2/1966 | Lynes | 175/230 X |
| 3,283,823 | 11/1966 | Warrington | 175/243 X |
| 4,417,600 | 11/1983 | Kohn | 175/218 X |
| 4,635,717 | 1/1987 | Jageler | 166/250 |
| 4,804,050 | 2/1989 | Kerfoot | 175/20 |
| 4,887,646 | 12/1989 | Groves | 73/49.8 X |
| 4,928,758 | 5/1990 | Siegfried, II | 73/152.34 X |
| 5,563,512 | 10/1996 | Mumby | 73/152.02 X |

*Primary Examiner*—Thomas P. Noland
*Attorney, Agent, or Firm*—Luther A. Marsh

[57] ABSTRACT

A zone isolator module for use on a penetrometer comprises a tubular body having an annular recess in an exterior wall thereof, an elastomer membrane fixed in the annular recess and adapted to lie against an inner surface of the recess, a sleeve slidably disposed on the tubular body and slidably movable between a first position in which the sleeve completely covers the recess, and a second position in which the sleeve is substantially removed from the recess, and the body having an opening extending outwardly from an axial central bore therethrough to the inner surface of the recess, whereby fluid flowed through the bore and the opening operates to expand the elastomer membrane against the sleeve when the sleeve covers the recess and to expand the elastomer membrane beyond the exterior wall of the body when the sleeve is substantially removed from the recess.

5 Claims, 2 Drawing Sheets

ZONE ISOLATOR MODULE FOR USE ON A PENETROMETER

BACKGROUND OF THE INVENTION

1. Field of the Invention

This invention relates to soil fluid sampling and injection of fluids into a soil, and is directed more particularly to a module for use with a penetrometer for isolating a soil zone adjacent the penetrometer.

2. Description of the Prior Art

Penetrometers are known in the art and typically comprise pointed rod-like members, at least in part hollow to permit passing therethrough of instrument cables, actuating cables, fluid delivery tubes, and the like, for tools, instruments, sensors, and the like, mounted on the penetrometer, and for capturing fluid samples or delivering a fluid to the soil.

A problem encountered in use of the penetrometer is the vertical movement of fluids along the rod/soil interface during fluid sampling or fluid injection into the soil around the penetrometer. It has been the practice to assume the soil pressure against the penetrometer seals against vertical migration of fluids and to do nothing further. Even when it is apparent that vertical migration is taking place, there heretofore has been no means by which to stop such migration.

Accordingly, there exists a need for a means for use with a penetrometer to prevent vertical migration of fluid around the penetrometer rod, so that fluids may be sampled or introduced at specific levels in the soil.

SUMMARY OF THE INVENTION

It is, therefore, an object of the invention to provide a module for connection to a penetrometer rod, which module serves to isolate a particular zone of soil abutting the penetrometer, such that fluids do not migrate between the soil and penetrometer along the length of the penetrometer.

With the above and other objects in view, as will hereinafter appear, a feature of the present invention is the provision of a zone isolator module for use on a penetrometer, the module comprising a tubular body having an annular recess in an exterior wall thereof, an elastomer membrane fixed in the annular recess and adapted to lie against an inner surface of the recess. A sleeve is slidably disposed on the tubular body and is slidably movable between a first position in which the sleeve completely covers the recess, and a second position in which the sleeve is substantially removed from the recess. The body is provided with an opening extending outwardly from an axial central bore therethrough to the inner surface of the recess. Fluid flowed through the bore and the opening operates to expand the elastomer membrane against the sleeve when the sleeve covers the recess and to expand the elastomer membrane beyond the exterior wall of the body when the sleeve is substantially removed from the recess.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown a illustrative embodiment of the invention, from which its novel features and advantages will be apparent.

In the drawings.

DESCRIPTION OF THE PREFERRED EMBODIMENT

Figure 1:
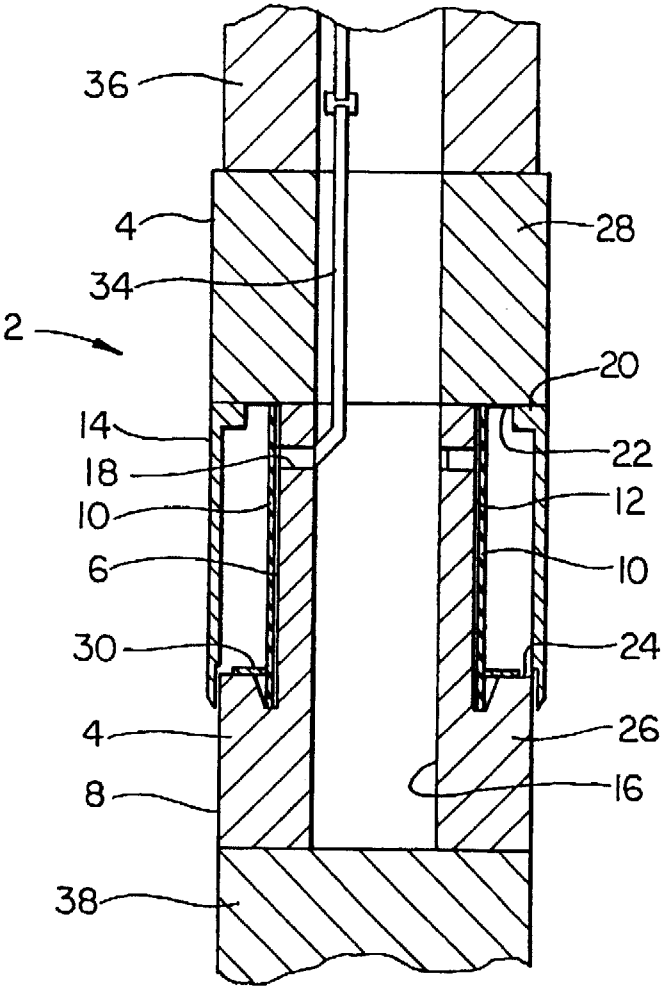
FIG. 1 is a centerline sectional view of one form of module illustrative of an embodiment of the invention.

Referring to FIG. 1, it will be seen that the illustrative module 2 includes a tubular body 4 having therein an annular recess 6 in an exterior wall 8 thereof. An elastomer membrane 10 is fixed in the recess 6 and is adapted to lie against an inner surface 12 of the recess 6.

Figure 2:
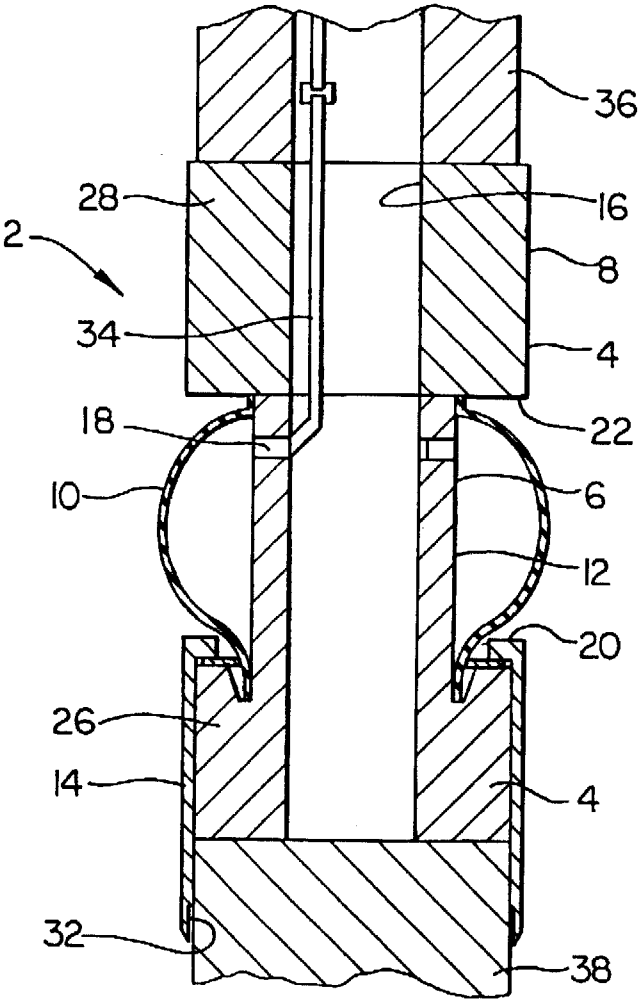
FIG. 2 is similar to FIG. 1, but shows operative components in positions different from FIG. 1.

A sleeve 14 is slidably disposed on the body 4 and is slidably movable on the exterior wall 8 thereof between a first position, shown in FIG. 1, wherein the sleeve 14 completely covers the recess 6, and a second position, shown in FIG. 2, wherein the sleeve 14 is substantially removed from the recess 6.

The tubular body 4 is provided with an axial central bore 16 extending through the body 4. An opening 18 extends outwardly from the bore 16 to the inner surface 12 of the recess 6.

The sleeve 14 is provided with an inwardly-extending flange 20 at an upper end of the sleeve. The flange 20 is engageable with an upper wall 22 of the recess 6 when the sleeve 14 covers the recess (FIG. 1), and is engageable with a lower wall 24 of the recess 6 when the sleeve is substantially removed from the recess (FIG. 2).

For ease of construction, the tubular body 4 preferably includes a tubular member 26 having therein the recess inner surface 12 and lower wall 24, and an adapter 28 fixed to the tubular member 26, as by screw threads (not shown), or the like, and which defines the upper wall 22 of the recess 6.

Fixed to an outer surface of the elastomeric membrane 10 is an annular split ring 30. The lower end of the sleeve 14 is provided with a recess 32 on its inner surface adapted to receive the split ring 30 to prevent sliding movement of the sleeve, as will be further described hereinbelow.

A fluid delivery tube 34 may extend through the module bore 16 to the opening 18.

In operation, the module 2 typically is fixed, as by screw threads (not shown), or the like, to a penetrometer rod 36 and/or cone member 38 (FIGS. 1–5). In practice, it is useful to affix two modules 2, 2' (FIG. 6) to the penetrometer rod 36, often between the rod 36 and the cone member 38. An adapter 28' disposed between the two elastomer membranes 10 is provided with an opening 40 for dispensing a fluid into surrounding soil, or for drawing fluid from the soil into the bore 16. There may be provided in the bore 16 a tube (not shown) for conveying fluid between the soil site and a surface station, as is known in the penetrometer arts.

Figure 4:
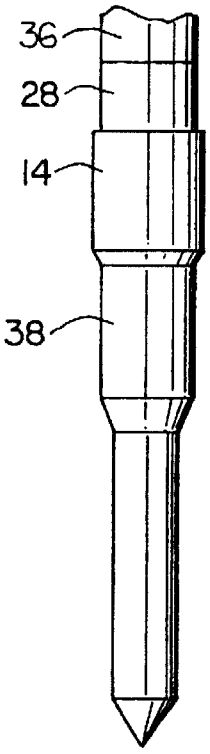
FIG. 4 is a side elevational view of the module of FIGS. 1–3 fixed to a penetrometer.

The penetrometer and isolator module are assembled together for sample taking, for example, with the sleeves 14 in the raised position, as shown in FIGS. 1 and 4. As the assembly is driven into the soil, its movement forces the sleeves 14 upwardly, urging the sleeves to maintain contact with the recess upper walls 22, to thereby cover and protect the elastomer membranes 10.

Figure 6:
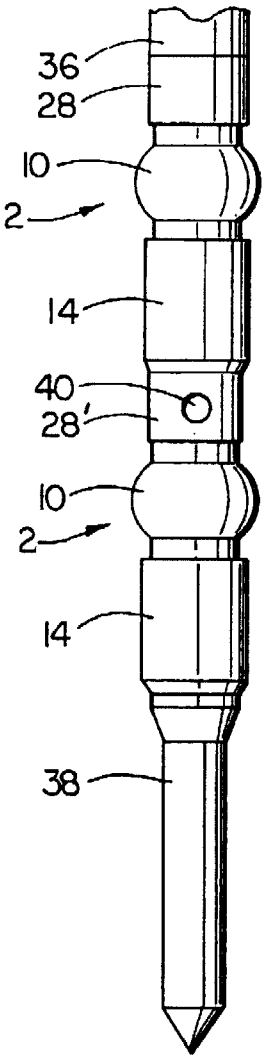
FIG. 6 is a side elevational view of two of the modules of FIG. 5 mounted on a penetrometer.
Figure 5:
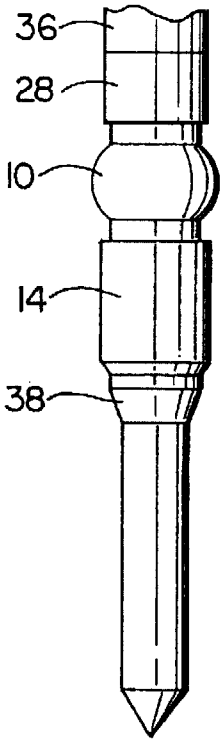
FIG. 5 is similar to FIG. 4, but shows the module in expanded condition.

Upon reaching the desired sampling depth, the penetrometer is driven a short distance further and then raised to the desired depth. Upon raising of the assembly, the pressure of the soil around each sleeve 14 holds the sleeve in place while the tubular body 4 is being raised, uncovering the elastomer membrane 10 which may then be expanded by fluid passing through the fluid delivery tube 34 and the opening 18 (FIGS. 2, 5 and 6). The membranes 10 are expanded to the circumference of the module, or slightly therebeyond, to forcefully engage the soil. If modules are used as shown in FIG. 6, two elastomer members 10 isolate a level of soil therebetween from which sample fluids may be taken into the opening 40. The expanded members 10 prevent fluids from above and below the selected zone migrating into the zone. In practice, a plurality of such zones may be sampled simultaneously by stacking a selected number of modules in a penetrometer assembly.

Figure 3:
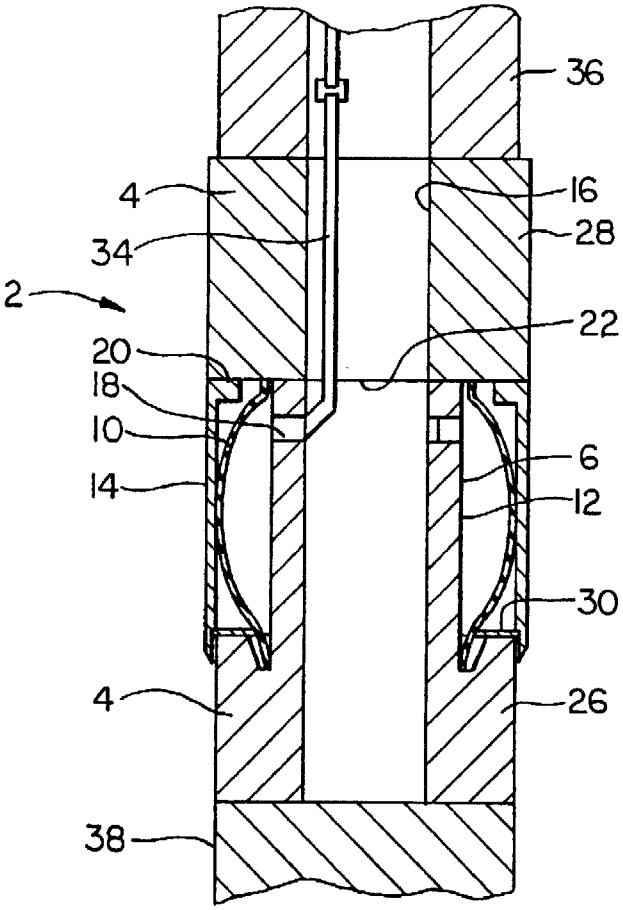
FIG. 3 is similar to FIGS. 1 and 2, but shows operative components in positions different from FIGS. 1 and 2.

When it is desired to raise the penetrometer and module assembly, the membranes 10 are deflated and the penetrometer is driven downwardly a distance sufficient to cause the sleeves 14 to again cover the membranes. The membranes 10 are then inflated slightly, as shown in FIG. 3, to cause the split rings 30 to enter the recesses 32, to lock the sleeves 14 against sliding movement. The penetrometers are then withdrawn with the sleeves 14 locked in the protective positions. When desired, deflation of the membranes removes the split rings from the recesses and the sleeves are again free for movement.

There is thus provided a means for isolating a zone in the soil for penetrometer operations at a selected depth without cross-over of fluids from the other levels through which the penetrometer passes, and/or from therebelow.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. A zone isolator module for use on a penetrometer, said module comprising:

a tubular body having an annular recess in an exterior wall thereof;

an elastomer membrane fixed in said annular recess and adapted to lie against an inner surface of said recess;

a sleeve slidably disposed on said tubular body and slidably moveable between a first position in which said sleeve completely covers said recess, and a second position in which said sleeve is substantially removed from said recess; and said body having a opening extending outwardly from an axial central bore therethrough to said inner surface of said recess;

whereby fluid flowed through said bore and said opening operates to expand said elastomer membrane against said sleeve when said sleeve covers said recess and to expand said elastomer membrane beyond said exterior wall of said body when said sleeve is substantially removed from said recess.

2. The module in accordance with claim 1 wherein said sleeve is provided with an inwardly-extending flange at one end of said sleeve, said flange being engageable with an upper wall of said recess when said sleeve covers said recess, and being engageable with a lower wall of said recess when said sleeve is substantially removed from said recess.

3. The module in accordance with claim 2 wherein said sleeve is slidable on said exterior wall of said body.

4. The module in accordance with claim 3 wherein said tubular body comprises (1) a tubular member having therein said recess inner surface and said recess lower wall, and (2) an adapter fixed to said tubular member and defining said recess upper wall.

5. The module in accordance with claim 3 further comprising a split ring fixed to the exterior of said membrane, and a recess in an inner wall of said sleeve, said recess being adapted to receive said split ring to prevent sliding movement of said sleeve.

* * * * *